US010370131B2

(12) United States Patent
Quinones

(10) Patent No.: US 10,370,131 B2
(45) Date of Patent: Aug. 6, 2019

(54) APPARATUS AND METHOD FOR PACKAGING COILED MATERIALS

(71) Applicant: Victor Manuel Quinones, San Antonio, TX (US)

(72) Inventor: Victor Manuel Quinones, San Antonio, TX (US)

( * ) Notice: Subject to any disclaimer, the term of this patent is extended or adjusted under 35 U.S.C. 154(b) by 365 days.

(21) Appl. No.: 15/297,091

(22) Filed: Oct. 18, 2016

(65) Prior Publication Data

US 2017/0174372 A1 Jun. 22, 2017

Related U.S. Application Data

(60) Provisional application No. 62/269,027, filed on Dec. 17, 2015.

(51) Int. Cl.

| | |
|---|---|
| ***B65B 11/08*** | (2006.01) |
| ***B65B 27/06*** | (2006.01) |
| ***B65B 31/00*** | (2006.01) |
| ***B65B 35/10*** | (2006.01) |
| ***B65B 41/12*** | (2006.01) |
| ***B65B 51/02*** | (2006.01) |
| ***B65B 63/04*** | (2006.01) |
| ***B65B 25/24*** | (2006.01) |

(Continued)

(52) U.S. Cl.

CPC ..... *B65B 11/08* (2013.01); *B65B 11/004* (2013.01); *B65B 25/24* (2013.01); *B65B 27/06* (2013.01); *B65B 31/00* (2013.01); *B65B 35/10* (2013.01); *B65B 41/12* (2013.01); *B65B 51/02* (2013.01); *B65B 63/04* (2013.01); *B65B 65/006* (2013.01); *B65B 2210/02* (2013.01)

(58) Field of Classification Search

CPC ..... B65B 25/24; B65B 65/006; B65B 11/004; B65B 11/08; B65B 27/06; B65B 31/00; B65B 35/10; B65B 41/12; B65B 51/02; B65B 63/04; D01H 7/16; B65D 85/66–677

USPC ..... 53/459, 430, 409, 204, 372, 371.7

See application file for complete search history.

(56) References Cited

U.S. PATENT DOCUMENTS 1,361,889 A * 12/1920 Miller ..... B60B 29/002 105/157.1

1,380,448 A * 6/1921 Wheildon ..... B65B 25/24 53/136.3

(Continued)

FOREIGN PATENT DOCUMENTS

JP 4-215951 8/1992

*Primary Examiner* — Alexander M Valvis
*Assistant Examiner* — Eduardo R Ferrero
(74) *Attorney, Agent, or Firm* — Richard C. Litman

(57) ABSTRACT

The apparatus and method for packaging coiled materials uses vacuum to draw the free end of a packaging sleeve through the open coil core, which may have a single line. A trolley lifts the coil to align its open core with a hollow mandrel, and passes the coil over the mandrel. The trolley is lowered to expose the coil circumference for packaging. Suction is applied through the mandrel to draw the free end of the sleeve through the coil core. Another apparatus includes two parallel input lines and a mandrel workstation translating therebetween and pivoting to transfer coils to an orthogonal output line. Another apparatus includes a stationary suction source having a flexible suction hose and suction canister extending therefrom. The canister is applied to the coil core to draw the free end of the sleeve therethrough.

6 Claims, 20 Drawing Sheets

(51) Int. Cl.
*B65B 65/00* (2006.01)
*B65B 11/00* (2006.01)

(56) References Cited

U.S. PATENT DOCUMENTS 1,394,266 A * 10/1921 Angier ..... B65B 25/24 53/137.2
1,964,119 A * 6/1934 Hendry ..... B66F 5/00 211/23
2,504,947 A * 4/1950 Grange ..... B65B 27/06 100/1
2,668,402 A * 2/1954 Whytlaw ..... B65B 25/24 206/397
2,692,464 A * 10/1954 Thompson ..... B65B 25/24 53/204
2,751,733 A * 6/1956 Nelson ..... B65B 25/24 53/587
2,756,870 A * 7/1956 Clark ..... B65B 27/06 198/721
2,883,925 A * 4/1959 Pritchard ..... B65B 27/06 100/1
2,901,966 A * 9/1959 Bocher ..... B65B 27/06 100/10
3,129,658 A * 4/1964 Valente ..... B65B 27/06 100/12
3,145,859 A * 8/1964 Barosko ..... B60B 29/002 414/427
3,212,429 A * 10/1965 Fay ..... B21C 47/24 100/100
3,448,680 A * 6/1969 Weber ..... B65B 27/06 100/10
3,633,492 A * 1/1972 Gilvar ..... B65B 27/06 100/3
3,670,877 A * 6/1972 Reed ..... B65B 27/06 206/397
3,739,544 A * 6/1973 Hanemann ..... B65B 27/06 206/303
3,750,364 A * 8/1973 Miura ..... B65B 25/24 206/303
3,833,332 A * 9/1974 Amberg ..... B29C 49/0073 425/525
3,843,070 A * 10/1974 Reed ..... B65B 25/24 242/571.1
3,856,141 A * 12/1974 Reed ..... B65B 27/06 206/407
3,879,920 A * 4/1975 Langen ..... B65B 11/004 53/207
3,916,601 A * 11/1975 Thimon ..... B65B 25/24 53/204
3,935,694 A * 2/1976 Langen ..... B65B 11/004 53/389.1
3,941,323 A * 3/1976 D'Agnolo ..... B65H 67/086 242/476
3,992,766 A * 11/1976 Field ..... A61F 6/04 29/235
3,995,758 A * 12/1976 Kovaleski ..... B65H 49/04 414/426
4,133,168 A * 1/1979 Keller, Jr. ..... D01H 1/385 57/304
4,209,140 A * 6/1980 Seibert ..... B65H 54/54 242/559
4,269,016 A * 5/1981 Kopp ..... B65B 65/006 53/546
4,447,012 A * 5/1984 Woodruff ..... B65H 16/06 242/423.1
4,523,421 A 6/1985 Kataoka
4,578,925 A * 4/1986 Matsunami ..... B65B 25/24 156/74
4,643,305 A * 2/1987 De Roure Olivier ..... B65D 75/305 206/388
4,718,813 A * 1/1988 Kehlenbach ..... B65H 49/38 414/469
4,827,693 A * 5/1989 Egea ..... B65B 25/20 223/41
4,886,284 A * 12/1989 Martinez, Jr. ..... B60B 29/002 280/43.12
5,024,042 A * 6/1991 Meyer ..... B65B 39/007 53/168
5,114,012 A 5/1992 Mushinski et al.
5,400,567 A 3/1995 Lindstrand
5,524,415 A * 6/1996 Pachinger ..... B65B 11/00 242/557
5,716,022 A * 2/1998 Chiloff ..... B65H 16/103 242/552
5,775,515 A 7/1998 Chadwick
5,819,888 A * 10/1998 Tamura ..... F16D 59/02 188/218 XL
5,983,598 A * 11/1999 Quinones ..... B65B 25/24 53/409
6,070,389 A * 6/2000 Irvin ..... B26D 1/0006 53/228
6,192,656 B1 2/2001 Takahashi
7,597,524 B2 * 10/2009 Hernandez ..... B60B 29/002 414/426
10,155,600 B2 * 12/2018 Birch ..... B65B 31/02
2002/0139089 A1 * 10/2002 Pin ..... B65B 5/067 53/459
2003/0154697 A1 * 8/2003 Pellicer Thoma ..... B65B 5/022 53/570
2006/0201110 A1 * 9/2006 Quinones ..... B65B 25/24 53/409
2009/0308267 A1 * 12/2009 Song ..... B21C 37/08 100/8
2009/0308268 A1 * 12/2009 Song ..... B21C 47/24 100/8
2010/0255230 A1 * 10/2010 Hihnala ..... A22C 13/0013 428/34.8
2013/0055678 A1 3/2013 Olsson et al.
2014/0077469 A1 * 3/2014 Kotzur ..... B65B 25/24 280/79.6
2014/0260092 A1 * 9/2014 Eno ..... B65B 27/06 53/399
2015/0059290 A1 * 3/2015 Ewert ..... B65B 59/02 53/432
2015/0251785 A1 * 9/2015 Canini ..... B65B 25/146 53/209

* cited by examiner

APPARATUS AND METHOD FOR PACKAGING COILED MATERIALS

CROSS-REFERENCE TO RELATED APPLICATION

This application claims the benefit of U.S. Provisional Patent Application Ser. No. 62/269,027, filed on Dec. 17, 2015.

BACKGROUND OF THE INVENTION

1. Field of the Invention

The present invention relates generally to the packaging and wrapping industries, and particularly to an apparatus and method for packaging coiled materials, such as steel coils and the like.

2. Description of the Related Art

Many materials, e.g., steel of various alloys and other metals, plastics, etc., are often processed into coils or rolls after manufacture in order to provide for compact storage and convenient dispensing for use. Such coils of sheet material nearly universally require some form of external protection from the time they are coiled to the time when the material is dispensed from the coil. In the case of metals this is done primarily to protect the material from corrosion using some form of external packaging, while also serving to protect the exterior layer of material from physical damage, at least to some extent.

Accordingly, various forms of packaging for coiled materials have been developed in the past. One general method uses a banding device that passes through the open core of the coil and surrounds the core radially. A relatively narrow strip of material is then unwound from the banding device for application in a generally radial pattern around the coil, as the coil is rotated relative to the banding device.

Another general method applies a sheet of flexible material over and around the coil, with a portion of the wrapping material being drawn back through the open core to complete the packaging process. This is a relatively slow and cumbersome process, primarily due to the need to manually push the wrapping or packaging material through the open core from one end of the coil, and then to draw the packaging material through the remainder of the open core from the opposite end of the coil.

Thus, an apparatus and method for packaging coiled materials solving the aforementioned problems is desired.

SUMMARY OF THE INVENTION

The apparatus and method for packaging coiled materials comprises various embodiments, each of which utilizes a vacuum source to draw the free end of a plastic packaging or wrapping sleeve back through the open core of the coil. This greatly reduces the time otherwise required to manually push the free end of the packaging material partially through the hollow core, and then to draw the free end completely through the hollow core from the opposite end of the core.

In one embodiment, a single line with a vertically adjustable trolley thereon is provided to convey the coil of material to the wrapping station or workstation. The trolley lifts the coil to position the open core of the coil in coaxial alignment with a hollow mandrel extending from the workstation and conveys the coil to the workstation, whereupon the open core of the coil passes around or over the hollow mandrel. The coil support bed of the trolley is then lowered, and the trolley is removed with the mandrel of the workstation supporting the coil above and clear of the underlying input line.

An open-ended sleeve of plastic packaging or wrapping material, e.g., thin sheet plastic, etc., is then applied over the outer surface of the coil. The free end of the packaging material is inserted into the open core of the coil, and suction is applied through the hollow mandrel to draw the free end of the packaging material through the open core of the coil. The remaining free end of the packaging material is then extended about the end of the coil and sealed to the opposite end of the sleeve around the coil to complete the packaging process.

Another embodiment utilizes substantially the same procedure as described above, but comprises two parallel input lines to deliver coiled materials from two coil forming stations at the initial points of the two lines. The mandrel and its suction apparatus can translate laterally between the two lines, alternating between the two as required. The mandrel pivots 90° to deliver the partially wrapped or packaged coil to a single output line orthogonal to the input lines, where the wrapping and packaging process is completed.

Yet another embodiment is adapted for the application of wrapping or packaging material over a single isolated coil of material. This embodiment comprises a single stationary suction or vacuum source of sufficient power or capacity to draw the packaging material through the open core of the coil. A suction canister is connected to the suction source by a flexible suction hose, allowing the canister to be positioned at the end of the open core opposite the packaging material at the other end of the coil. Suction is applied when the canister is in position, thereby drawing the free end of the packaging material through the open core of the coil.

A method of packaging coiled materials is also disclosed herein, the method comprising further steps involving the application of protective edging material prior to applying the packaging sleeve and applying a circumferential band about the free end of the packaging material to complete the packaging process. The method is adaptable to the apparatus of either the first or the second embodiment.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
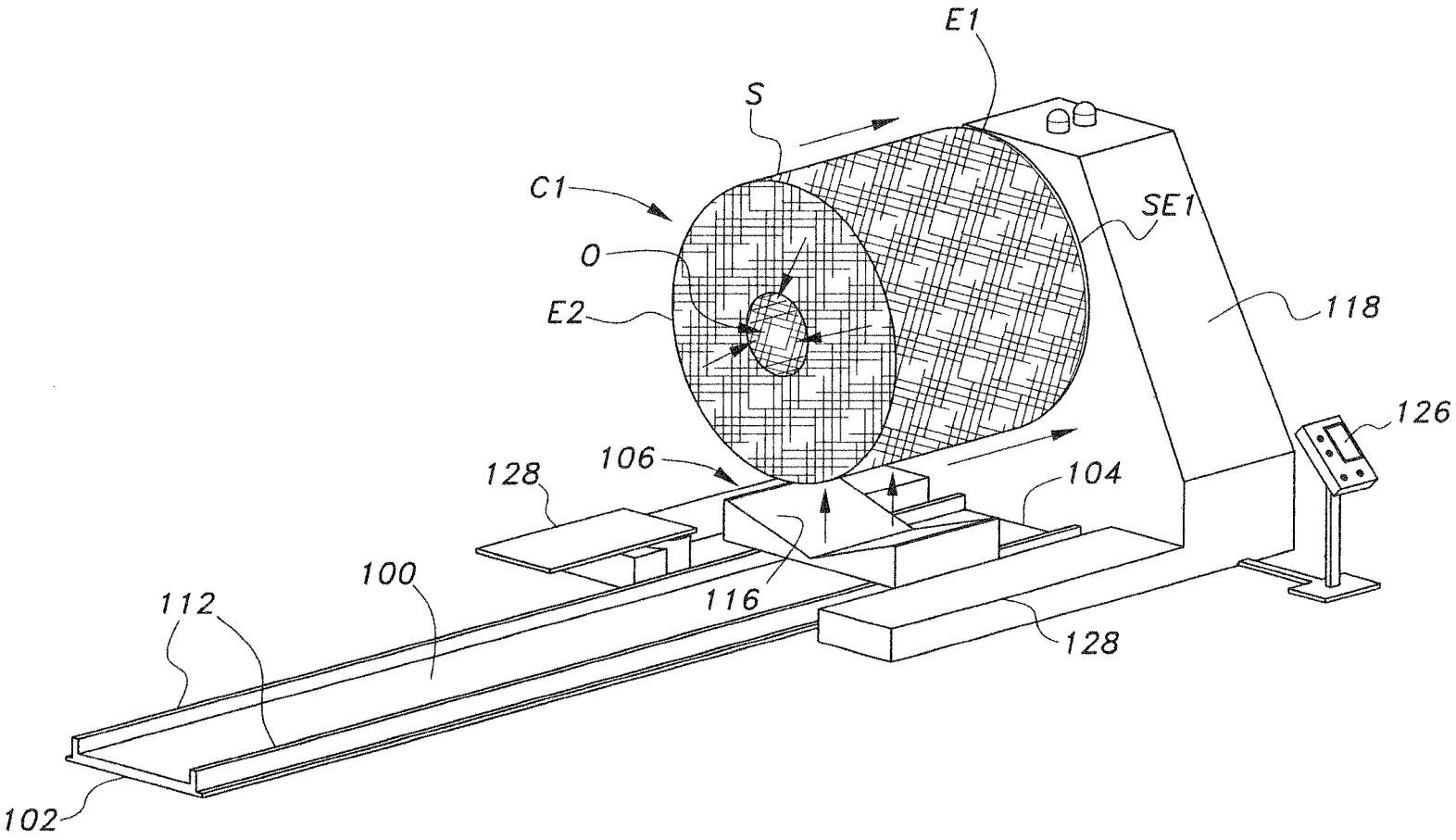
FIG. 1 is a perspective view of an apparatus for packaging coiled materials according to the present invention, illustrating its general features.

The apparatus and method for packaging coiled materials is adapted for the packaging of relatively large and heavy coils of material, such as steel and other metals, etc. The apparatus and method can also be adapted for the packaging of other coiled materials, such as long plastic sheets, etc. Such coils of material are quite bulky, often being a few feet in diameter and length, and may weigh on the order of ten tons or more, in the case of larger coiled rolls of steel sheet. The apparatus and method serve to accelerate the packaging process, also reducing the manual labor otherwise required for such packaging.

FIGS. 1 through 4 of the drawings illustrate a first embodiment of the apparatus and method for packaging coiled materials. The apparatus includes a single track or input line 100 having a first or coil receiving end 102 and an opposite second or wrapping end 104. A coil delivery trolley or dolly 106 is installed along the input line 100 and serves to convey a coil C of material from the first or receiving end 102 to the opposite second end 104 of the input line 100 for processing and wrapping. The trolley 106 includes a base 108 (FIGS. 2-4) having rollers or wheels 110 that roll along the rails 112 of the input line 100. A plurality of vertically adjustable struts 114, e.g., telescoping hydraulic struts, electric jackscrews, etc., extend upward from the lower platform and support a coil support bed 116 mounted thereon.

A workstation or wrapping station 118 is installed at the second end 104 of the input line 100. The workstation 118 includes a mandrel 120 (FIGS. 2 and 3) that extends horizontally from the workstation 118. The mandrel 120 serves to support the coil C above the bed 116 of the trolley 106 and/or above the input line 100 for wrapping or packaging the coil C. Such coils C are formed by rolling a long sheet of material having opposite first and second edges into a coil form, substantially as shown in FIGS. 1 through 4. The edges of the material define the opposite first and second ends E1 and E2 of the coil C. The coil C has an open core O due to the mandrel or shaft upon which the coil C was wrapped or coiled. The mandrel 120 of the packaging apparatus has a hollow core 122 and a high volume suction or vacuum pump 124 installed at the workstation 118 communicating with the hollow core 122 of the mandrel 120. The operation of the workstation 118 is controlled from an operator's control panel 126. Work platforms 128 are situated adjacent the workstation 118 to each side of the input line 100.

The coil packaging or wrapping apparatus of FIGS. 1-4 is used by initially positioning the trolley 106 toward the first end 102 of the input line 100, or at least clear of the workstation 118 and the mandrel 120. A coil C of material is then placed atop the coil support bed 116 of the trolley 106. The coil support bed 116 of the trolley 106 is adjusted vertically via its struts 114 to align the open core O of the coil C coaxially with the mandrel 120 of the workstation 118. The trolley 106 and the coil C thereon is then moved beneath the mandrel 120 while passing the open core O of the coil C around the mandrel 120, and the coil support bed 116 of the trolley 106 is then lowered to expose the complete circumference of the coil C for wrapping or packaging, generally as shown in FIG. 1 of the drawings. (FIG. 1 also shows the completely wrapped or packaged coil C.)

A plastic packaging sleeve S is then passed over or around the circumference of the coil C. The sleeve S has a generally tubular configuration, having a closed circumference and open opposed first and second ends, including first sleeve end SE1 and second sleeve end SE2. The first end SE1 of the sleeve S is passed over the second end E2 of the coil C, i.e., over the end of the coil farthest from the workstation 118, and drawn axially over the entire coil C until the first end SE1 of the sleeve S has reached the first end E1 of the coil. The first end SE1 of the sleeve S is then secured to the first end E1 of the coil C, e.g., by means of adhesive tape, etc.

Figure 2:
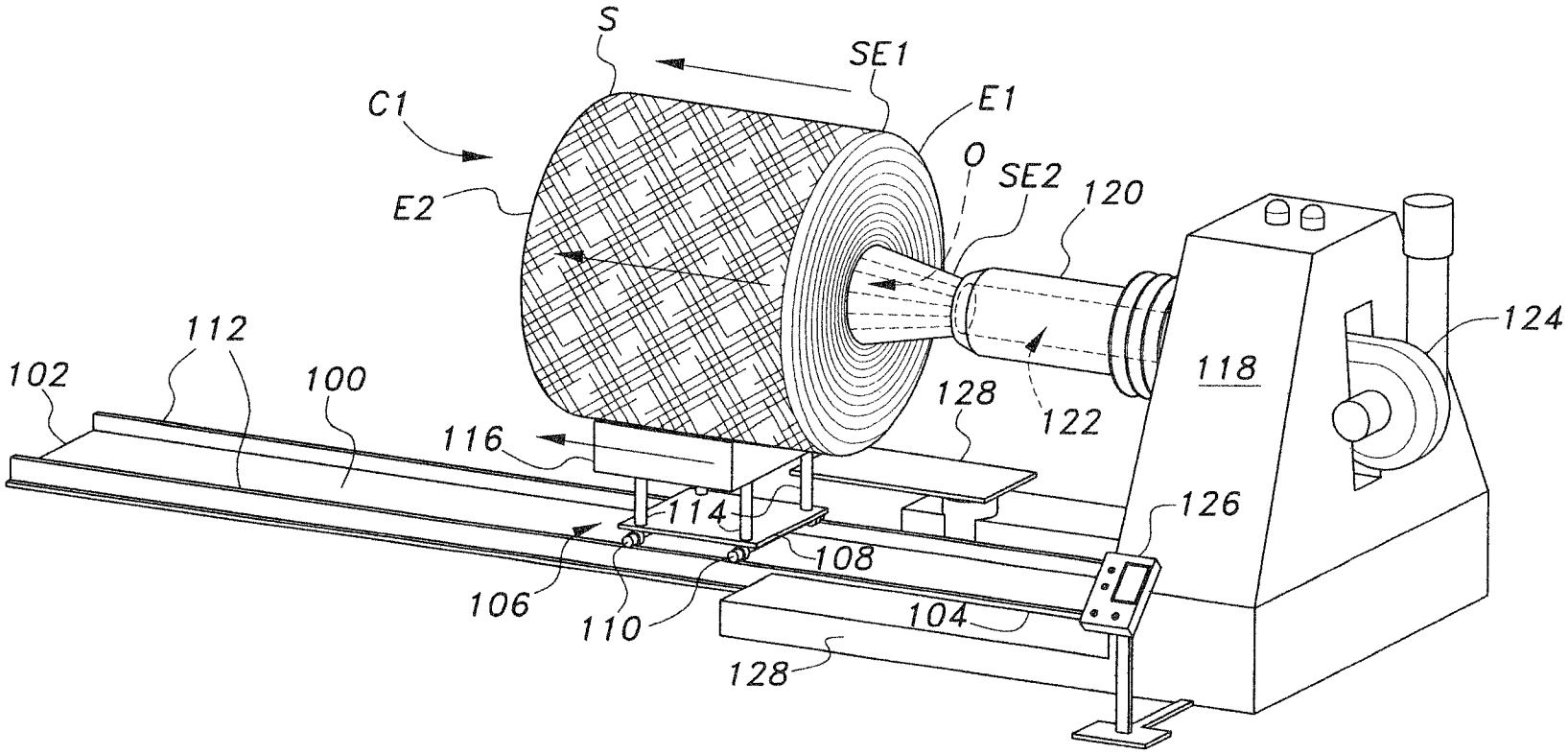
FIG. 2 is a perspective view of the apparatus of FIG. 1, showing one aspect of the operation thereof.

The remaining free second end SE2 of the sleeve S is then tucked loosely into the open core O of the coil C. The suction pump 124 of the workstation 118 is then actuated, so that the partial vacuum developed within the hollow mandrel 120 draws the remaining free second end SE2 of the sleeve S rapidly through the open core O of the coil C. The trolley 106 may then be repositioned beneath the coil C and the coil support bed 116 raised to support the coil C from the mandrel 120 of the workstation 118. The trolley 106 with its partially packaged coil C thereon is then moved away from the workstation 118 and the mandrel 120, generally as shown in FIG. 2 of the drawings.

Figure 3:
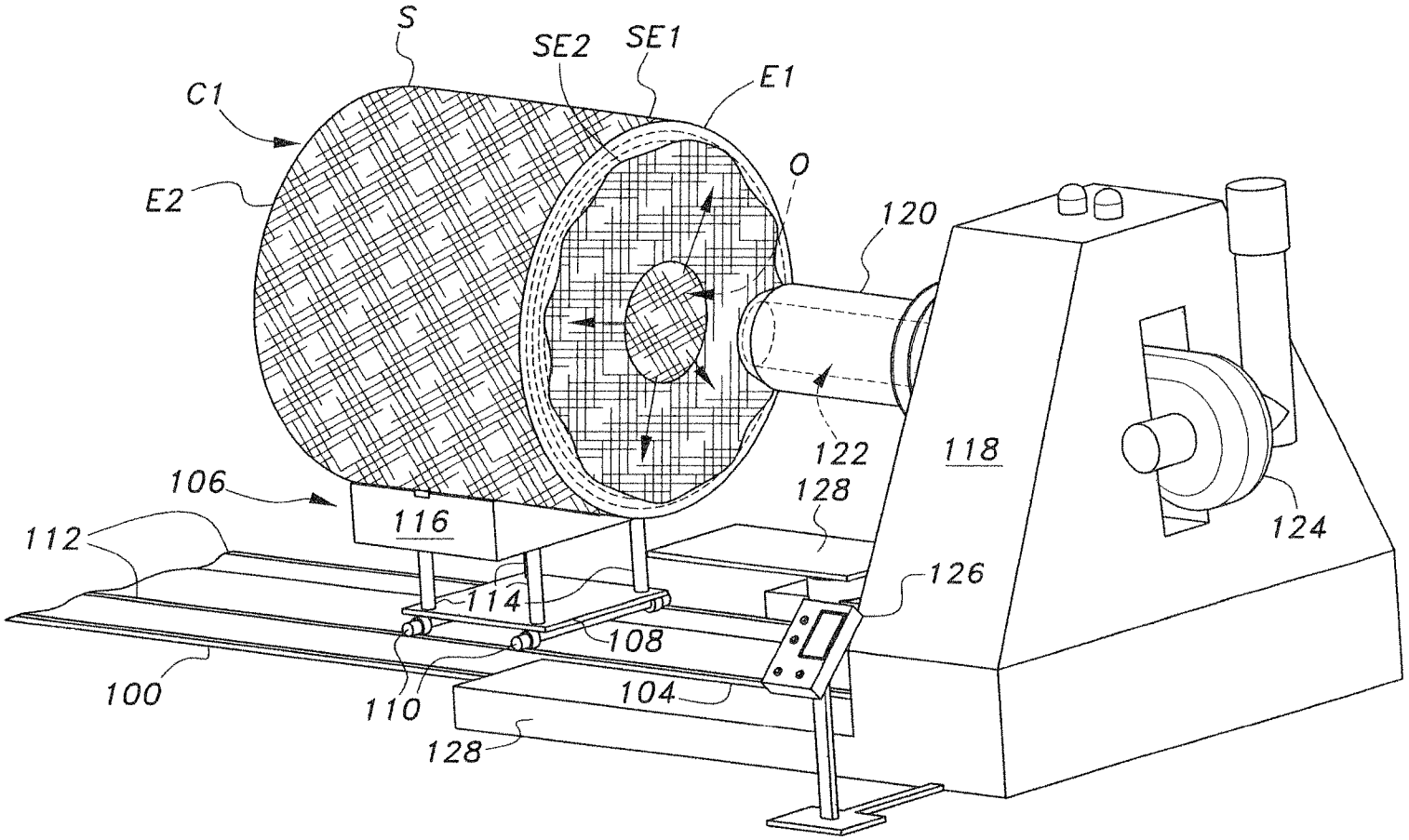
FIG. 3 is a detailed perspective view of the apparatus of FIG. 1, showing another aspect of the operation thereof.
Figure 4:
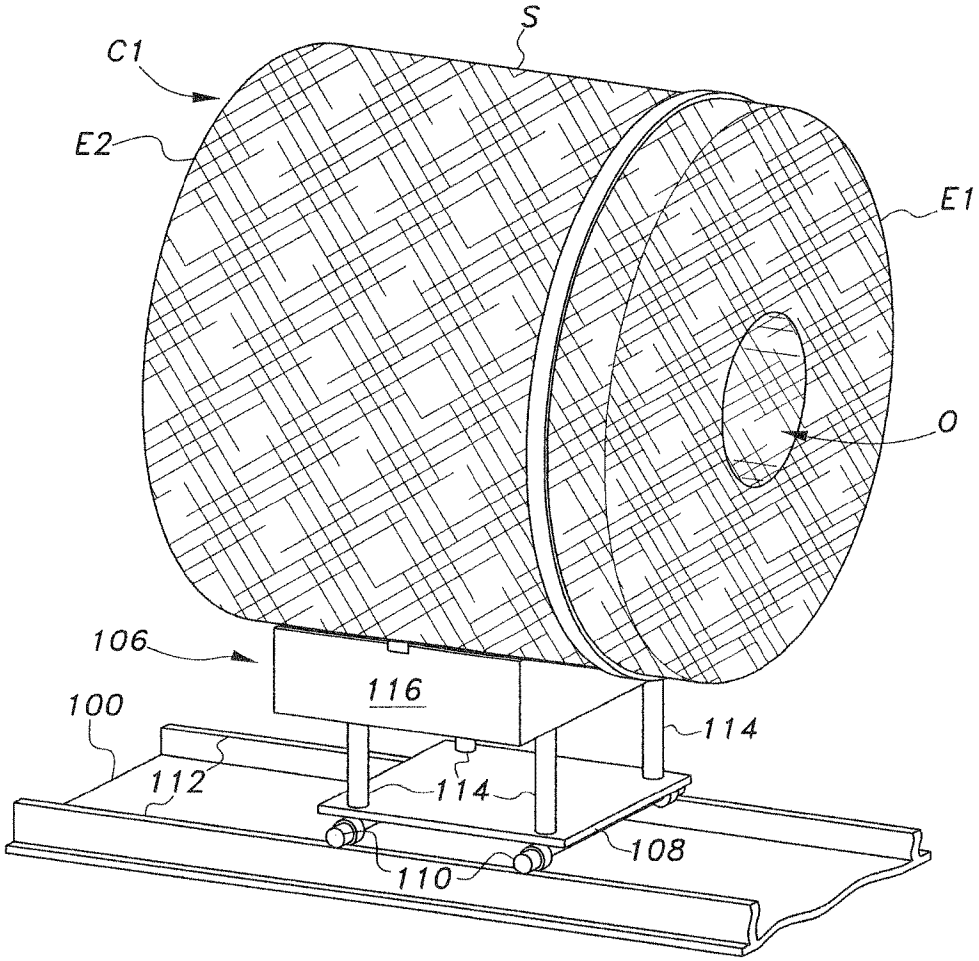
FIG. 4 is a detailed partial perspective view of a portion of the apparatus of FIG. 1, showing a completely packaged coil of material thereon.

At this point most of the coil C, i.e., the outer circumference, the second end E2, and the inner surface of the open core O, is enveloped in the packaging material, so that only the first end E1 remains exposed. The free portion of the packaging sleeve S terminating in the second end SE2 that has been drawn through the open core O of the coil C is then extended radially outward from the open core O of the coil C, generally as shown in FIG. 3, and secured over the previously secured first sleeve end SE1, e.g., by a circumferential band or strap, B, generally as shown in FIG. 4 of the drawings. This completes the wrapping or packaging process using the apparatus illustrated in FIGS. 1 through 4.

Figure 5:
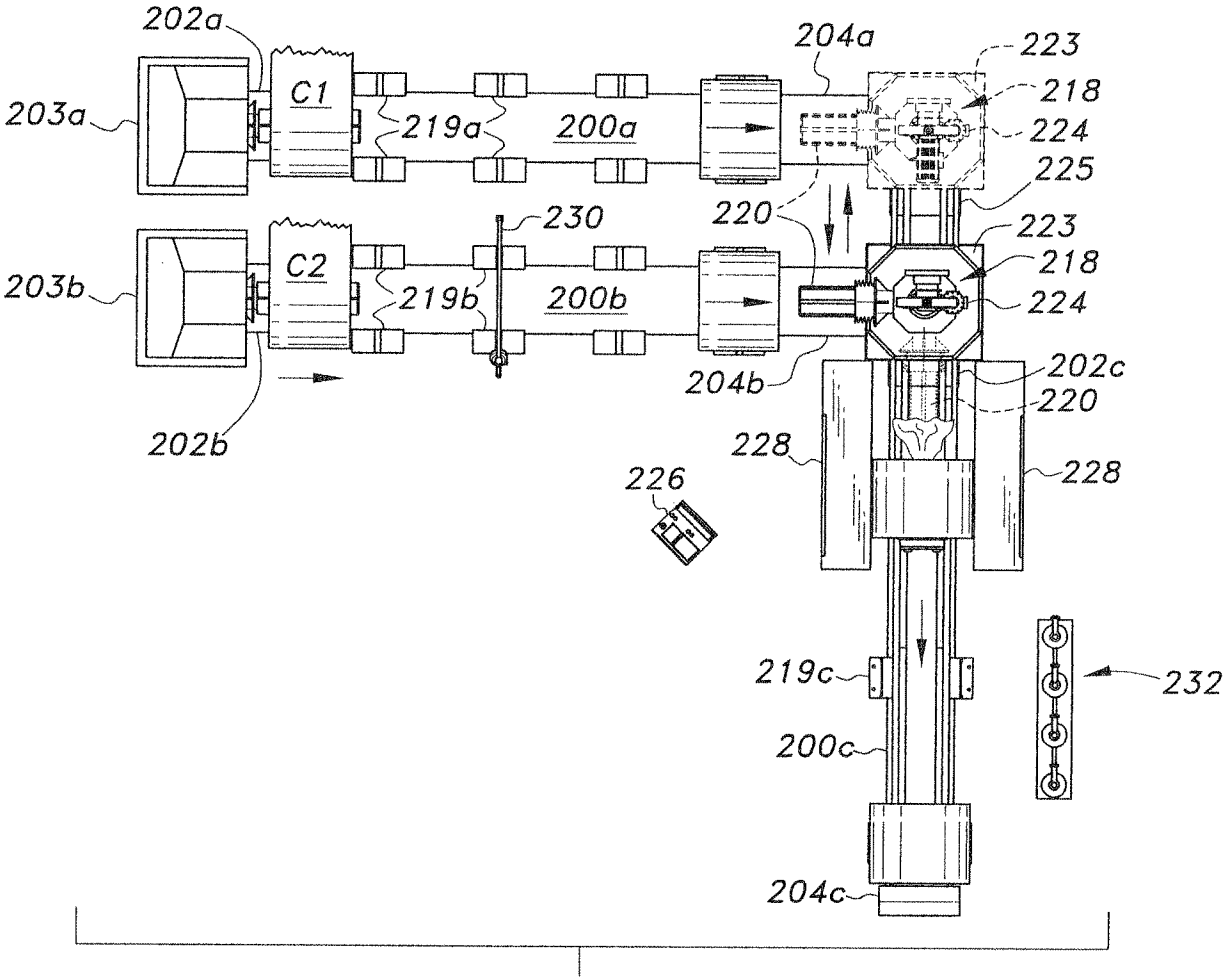
FIG. 5 is a top plan view of a second embodiment of an apparatus for packaging coiled materials according to the present invention, illustrating its general configuration.

FIGS. 5 through 19 illustrate another embodiment of a coil packaging apparatus. The apparatus of FIGS. 5 through 19 is more complete than that of the first embodiment, and includes coil rolling machines. The apparatus of FIGS. 5-19 has two parallel tracks or input lines 200*a* and 200*b* and a separate track or output line 200*c* orthogonal to the two input lines 200*a*, 200*b*. The two input lines 200*a*, 200*b* may comprise recessed channels in which the coil support trollies travel, as shown in FIGS. 5-19, or may have the rail configuration of the embodiment of FIGS. 1-4. Each of the input lines 200*a*, 200*b* includes a first end 202*a* and 202*b*, and an opposite second end 204*a* and 204*b*. The first end 202*c* of the output line 200*c* is adjacent the second end 204*b* of the second input line 200*b*. Coils C move from the input lines 200*a*, 200*b* onto the output line 200*c* during the coil packaging process. First and second coil rolling machines 203*a* and 203*b* are located at the respective first ends 202*a*, 202*b* of the two input lines 200*a*, 200*b*, as shown in FIG. 5 (the first ends 202*a*, 202*b* of the input lines 200*a*, 200*b* and the coil rolling machines 203*a*, 203*b* are deleted in other Figures.

Figure 14:
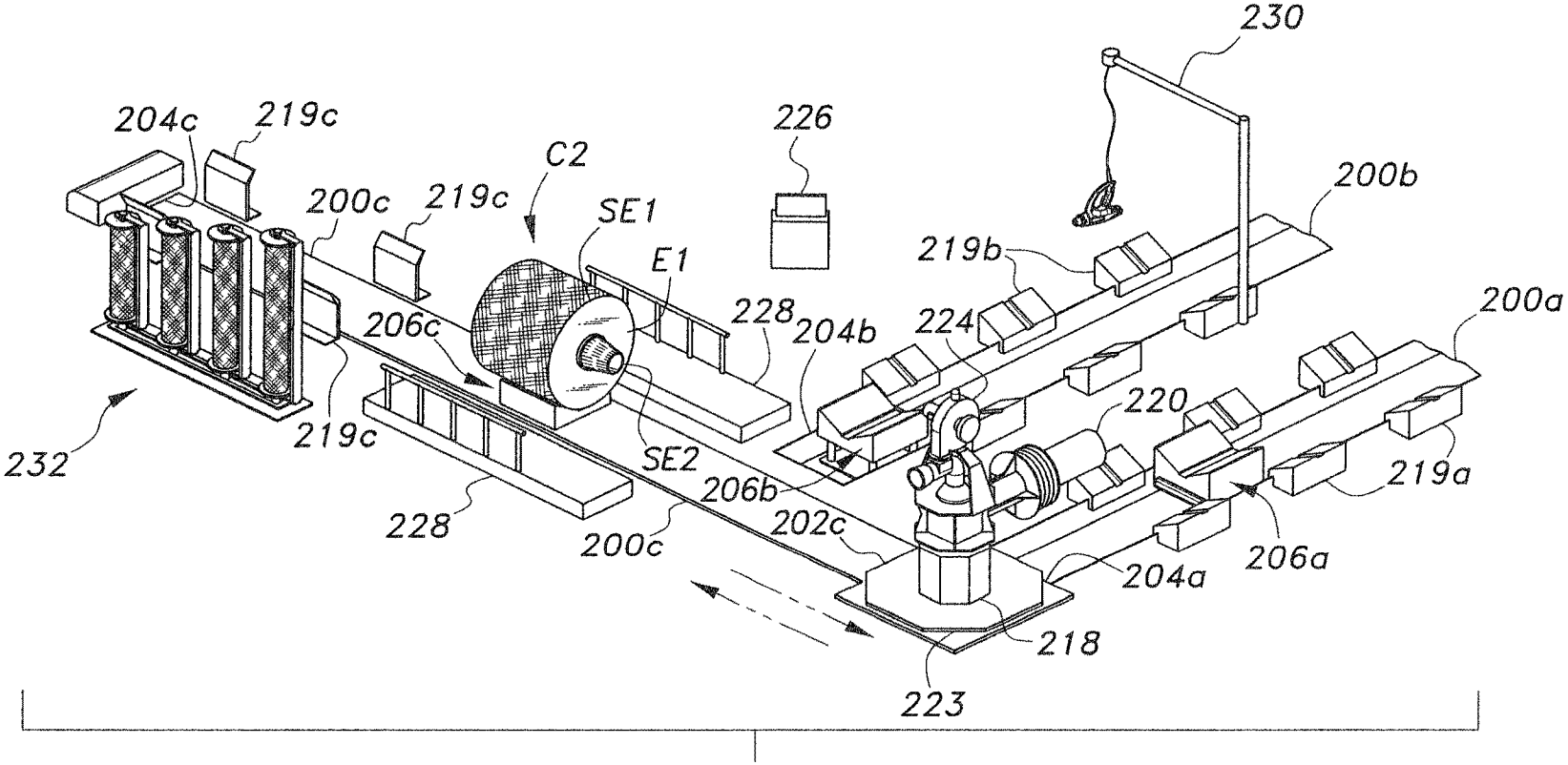
FIG. 14 is a partial perspective view of a portion of the apparatus of FIG. 5, illustrating a subsequent step in the packaging method.
Figure 15:
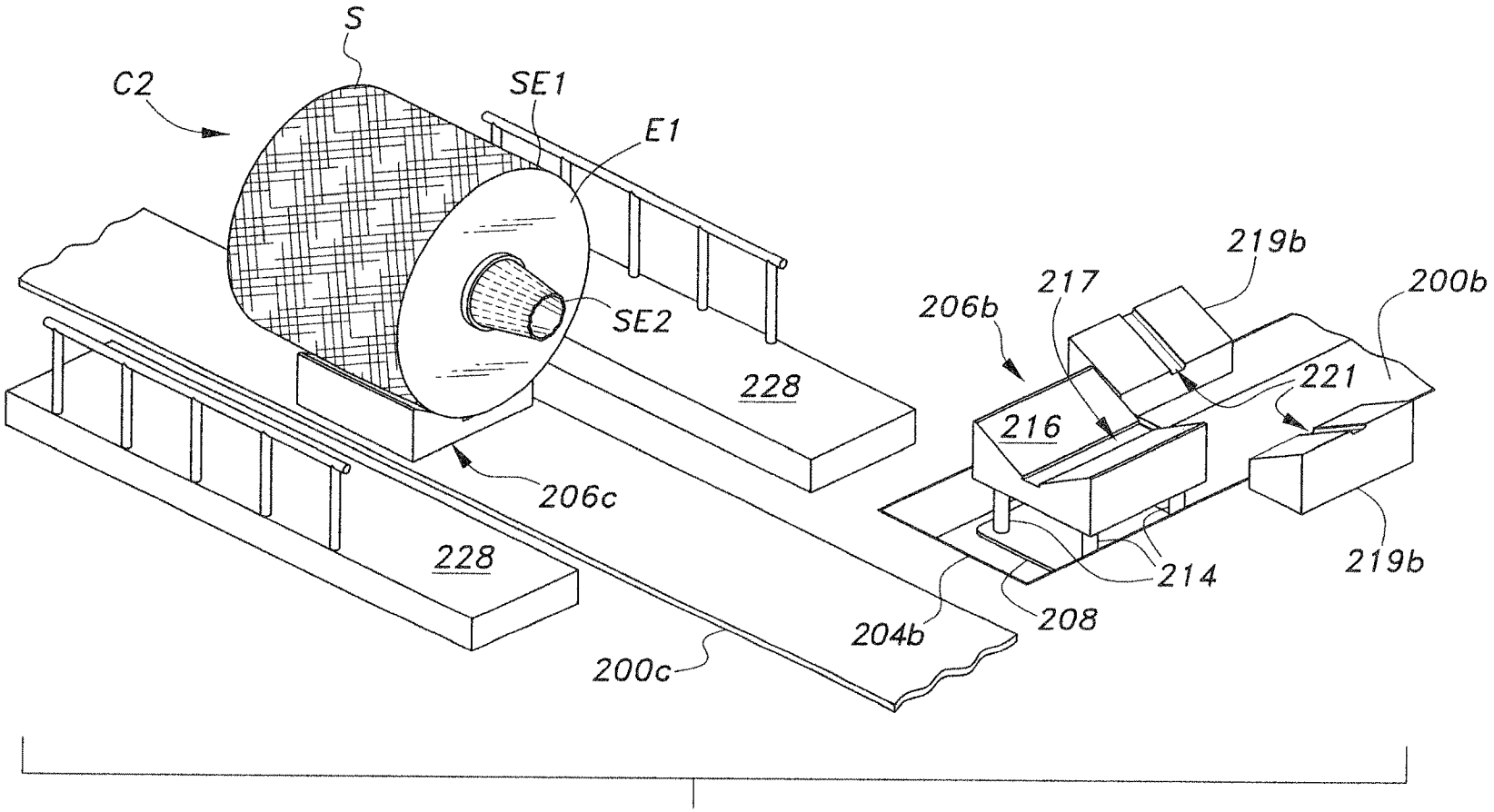
FIG. 15 is a partial perspective view of a portion of the apparatus of FIG. 5, illustrating a subsequent step in the packaging method.
Figure 16:
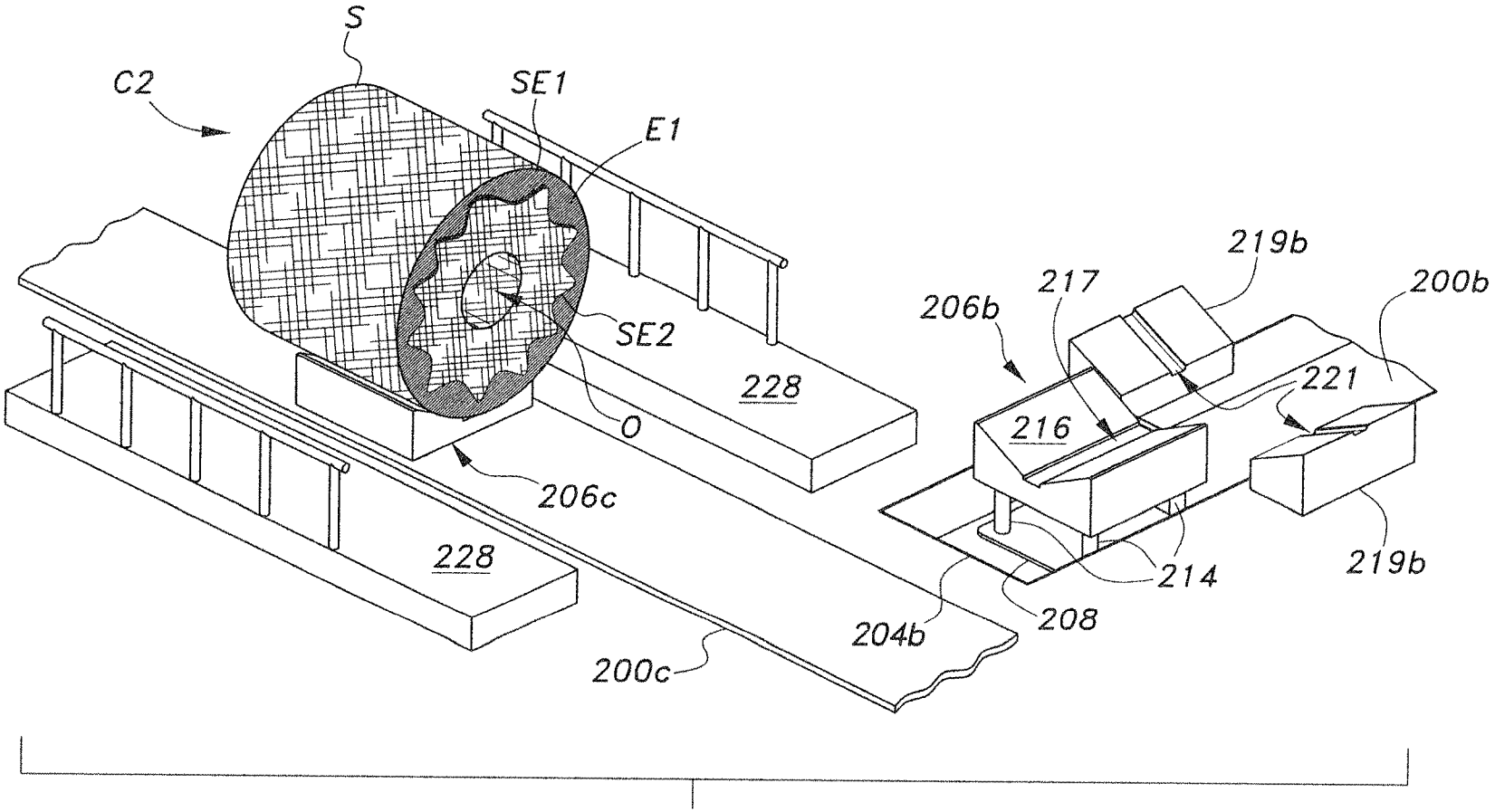
FIG. 16 is a partial perspective view of a portion of the apparatus of FIG. 5, illustrating a subsequent step in the packaging method.
Figure 17:
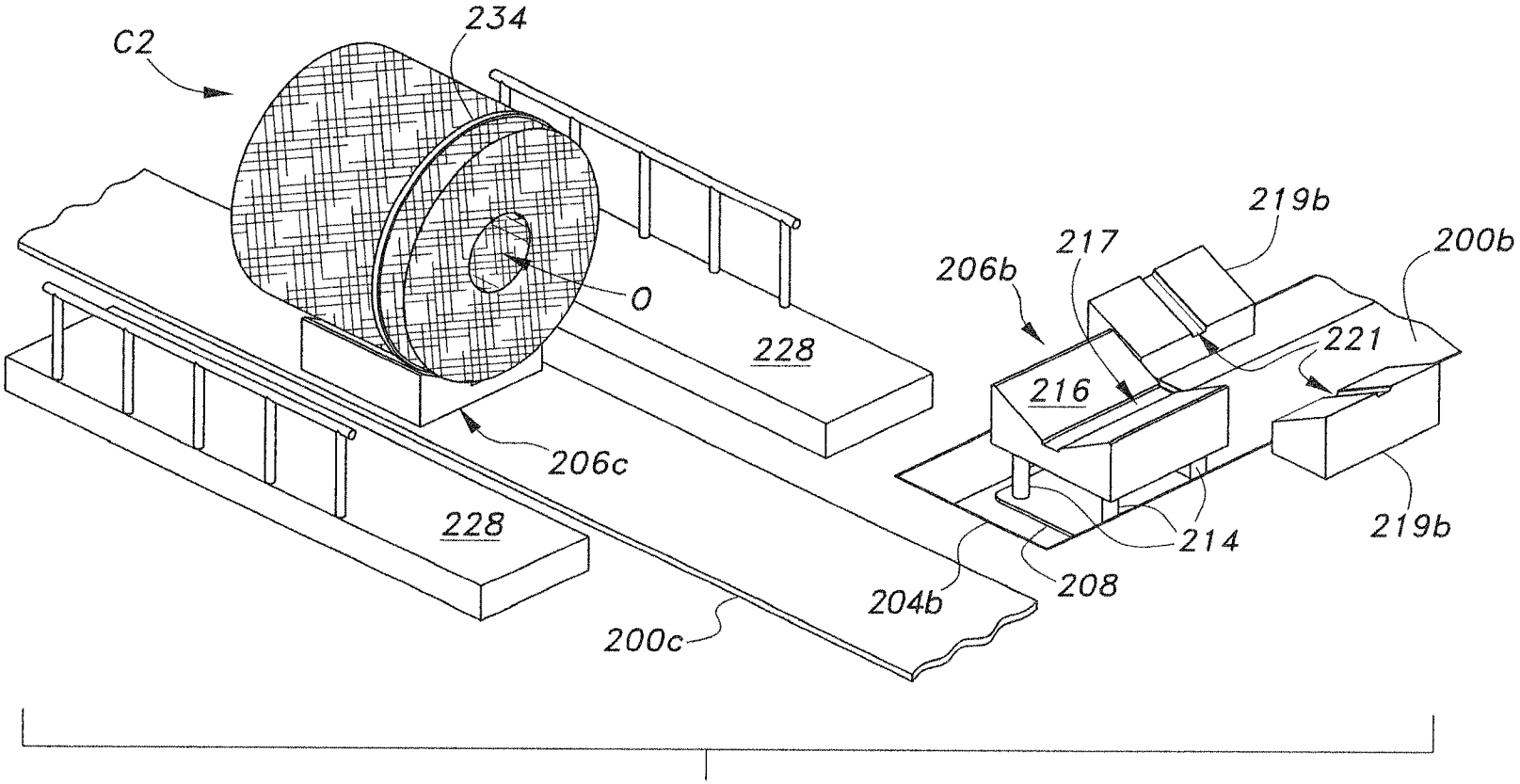
FIG. 17 is a partial perspective view of a portion of the apparatus FIG. 5, illustrating a subsequent step in the packaging method.

First and second coil transfer trollies 206*a* and 206*b* travel along the respective first and second input lines 200*a* and 200*b*, and a third coil transfer trolley 206*c* travels along the output line 200*c*. The trollies 206*a* through 206*c* are shown in FIGS. 6 through 19. FIGS. 15 through 17 provide more detailed views of the coil transfer trolley 206*b* of the second input line 200*b*. All of the trollies 206*a* through 206*c* are substantially identical to one another. Each of the trollies 206*a* through 206*c* is configured substantially like the trolley 106 of the first embodiment of FIGS. 1 through 4, i.e., having a base 208 traveling on rollers (similar to the rollers 110 of the trolley 106 of the first embodiment), and vertically adjustable struts 214 extending upward from the base 208 to support the coil support bed 216. These components 208, 214, and 216 are shown most clearly in FIGS. 15-19. The coil support beds 216 are provided with longitudinal slots, channels, or grooves 217 therein to allow straps to be passed through the core and along the outer surface of the coil material while the material is resting on the trolley.

Additional coil rests or stations 219*a* and 219*b* are disposed laterally along the two respective input lines 200*a* and 200*b*, and similar coil rests or stations 219*c* are disposed laterally along the output line 200*c*. The coil rests or stations 219*a*, 219*b* of the two input lines 200*a*, 200*b* are provided with lateral slots, channels, or grooves 221 therein to enable a circumferential band to be installed about a coil of material resting on one of the coil rests or stations 219*a* or 219*b*.

A workstation 218, similar to the workstation 118 of the first embodiment of FIGS. 1 through 4, is installed at the second ends 204*a* and 204*b* of the two input lines 200*a*, 200*b*. The workstation 218 is not immovably fixed at the ends of the input lines, however. Rather, it resides upon a mobile base 223 that travels back and forth along a short length of transfer track or line 225 that extends between the two second ends 204*a*, 204*b* of the two input lines 200*a* and 200*b*. It will be seen in FIG. 5 that the position of the workstation 218 at the second end 204*a* of the first input line 200*a* is shown in broken lines, while the workstation position at the second end 204*b* of the second input line 200*b* is shown in solid lines, indicating the variable position of the workstation 218. This enables the workstation 218 to pick up a coil C of material alternately between the two input lines 200*a* and 200*b*, thereby substantially doubling the processing rate for wrapping and packaging the coils C. It will be seen that this double input line arrangement can be increased further with the addition of more input lines and a longer transfer track for the workstation, if desired.

The workstation 218 is configured substantially like the workstation 118 of the embodiment of FIGS. 1-4. The workstation 218 has a mandrel 220 having a hollow core 222, and a suction or vacuum pump 224 communicating with the hollow core 222 of the mandrel 220. The workstation 218 can swivel upon its base 223 to align the mandrel 220 with either the input lines 200*a* or 200*b*, or to turn or rotate 90° to align the mandrel 220 with the orthogonal output line 200*c*, as shown in broken lines in FIG. 5. The mechanisms for translating the workstation 218 along the transfer track or line 225 and for rotating the station 218 to align the mandrel 220 with the input lines 200*a*, 200*b* or output line 200*c* may be electric, hydraulic, etc. Control of the entire packaging process, i.e., transfer of the coils C along the input and output lines 200*a* through 200*c* and operation of the workstation 218, is provided by a control panel 226. Work platforms 228 are located along both sides of the output line 200*c*, providing working areas for personnel applying the wrapping or packaging to the coils C after they have been transferred from the input lines 200*a*, 200*b* to the output line 200*c*.

The method or process for wrapping or packaging the coils of material is substantially like that described further above for the first embodiment of FIGS. 1-4, but includes some additional steps in keeping with the additional input line 200*b* and coil rolling machines 203*a*, 203*b*. When the sheet material has been formed into coils, e.g., coils C1 and C2, by the machines 203*a* and 203*b*, the respective coil delivery trolleys 206*a*, 206*b* are positioned beneath the coils C1, C2, and their coil support beds 216*a*, 216*b* are raised to lift the coils C1, C2 free of the mandrels of the coil forming machines. The trolleys 206*a*, 206*b* are then moved along their respective input lines 200*a*, 200*b* toward the opposite second ends 204*a*, 204*b* of the input lines, generally as shown in FIG. 5 of the drawings.

The coils C1, C2 must be secured to prevent the material from unwinding when the coils C1, C2 are lifted from the coil delivery trolleys 206*a*, 206*b*. This is accomplished at some intermediate point along the input lines 200*a*, 200*b* by passing a circumferential band B1 through the groove or channel 221 of the coil rest or station 219*a* or 219*b* and around the circumference of the coil C1 or C2, respectively. This operation is shown completed in FIG. 6, which shows the coil C2 resting upon its coil delivery trolley 206*b*. A band-dispensing machine or device 230 may be installed between the two input lines 200*a*, 200*b* and swiveled to provide banding material to a coil disposed upon either input line 200*a*, 200*b*, as required during the packaging operation. An additional axial or longitudinal band B2 may also be installed about the coil at this time, by passing the band B2 through the longitudinal channel or groove 217 disposed in the bottom center of the coil support bed 216*a* or 216*b* of the coil delivery trolley 206*a* or 206*b*, depending upon the input line upon which the coil is located.

It will be seen that the relatively sharp outer edges of the coils at ends E1 and E2 may tend to cut through the wrapping or packaging material used to envelop the coils C1, C2. Accordingly, at some point before the coils C1, C2 are packaged in the sleeves S, first and second edge protectors EP1 and EP2 are applied to the outer circumferences of the two ends E1 and E2 of each coil C1, C2 as it travels along the respective input line 200*a* or 200*b*. As the ends E1, E2 of the coils C1, C2 extend beyond their respective trolleys 206*a* or 206*b*, or the coil rest or station 219*a* or 219*b* upon which they may be positioned at the time, access to the complete circumference at each end E1 and E2 of the coil C1, C2 is available. The exact timing of the installation of the edge protectors EP1 and EP2 is accomplished prior to the placement of the packaging sleeve S over the coil C1, C2. It will be seen that these edge protectors EP1 and EP2 have been installed upon the coil C2 shown in FIGS. 6 and 7. This step of installing edge protectors is preferably accomplished during the coil packaging operation shown in FIGS. 1-4 as well.

Figure 6:
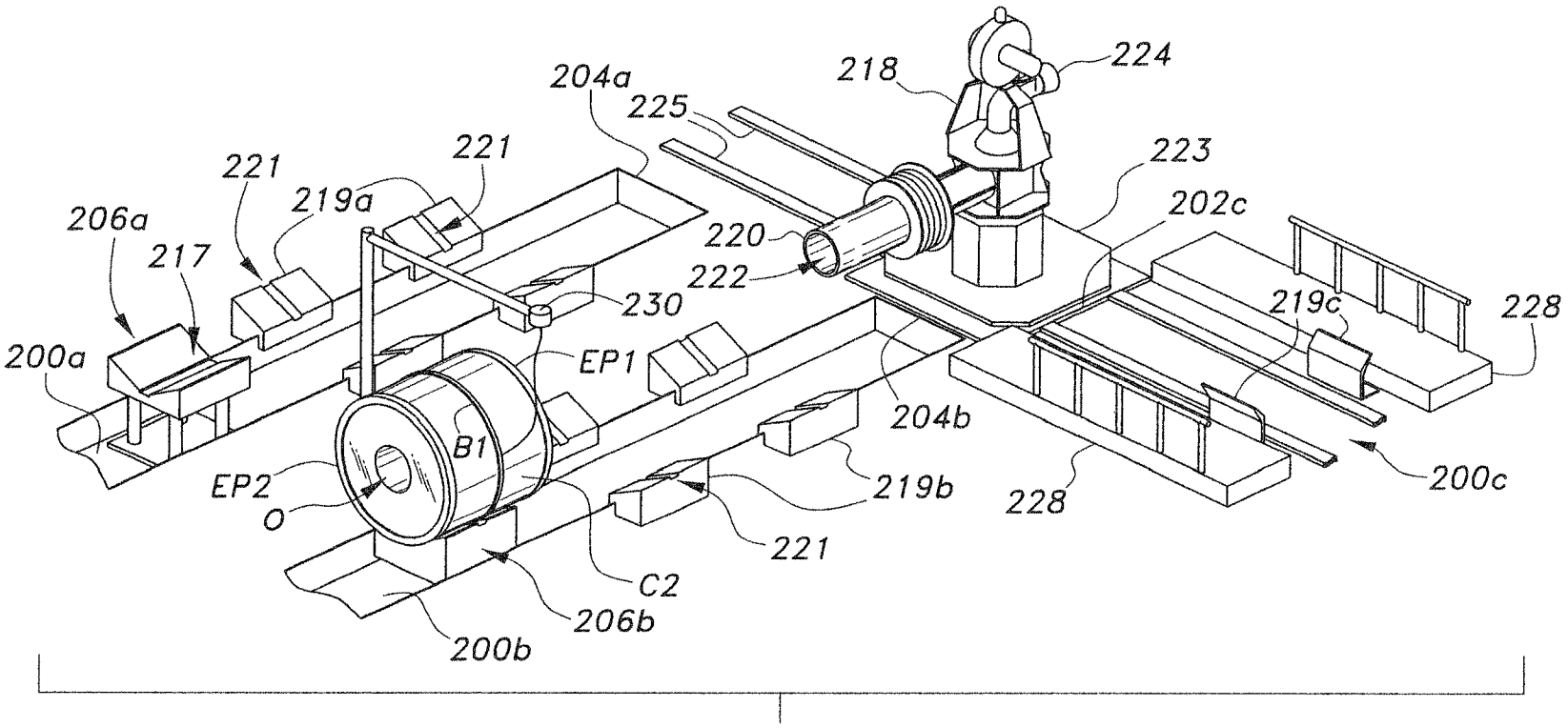
FIG. 6 is a partial perspective view of a portion of the apparatus of FIG. 5, illustrating an early step in the packaging method.
Figure 7:
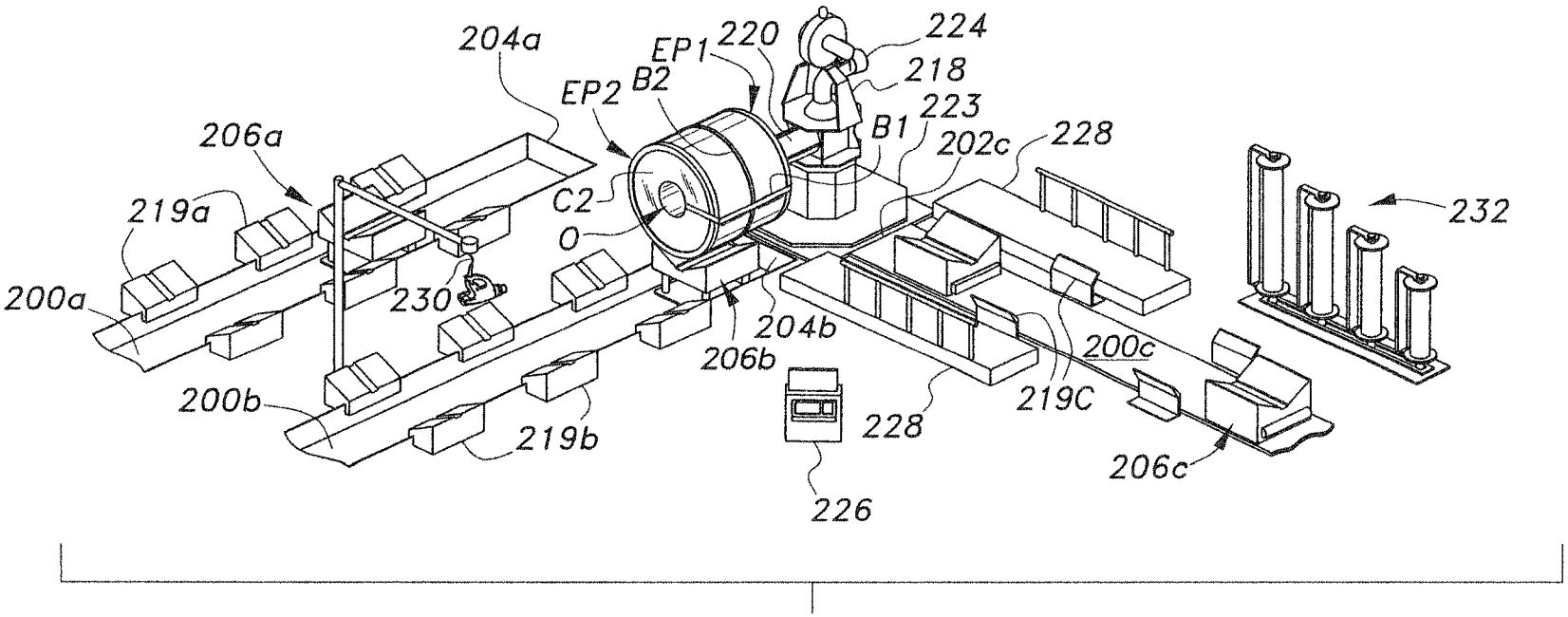
FIG. 7 is a partial perspective view of a portion of the apparatus of FIG. 5, illustrating a subsequent step in the packaging method.

As the coil support bed 216*a*, 216*b* of the coil delivery trolley 206*a*, 206*b* was previously raised to lift the completed coil C1, C2 from the winding mandrel of the coil rolling machine 203*a*, 203*b*, the open core O of the coil C1, C2 is positioned at substantially the proper height for placement over or around the hollow mandrel 220 of the workstation 218, generally as shown in FIG. 7 of the drawings. In the example of FIGS. 6 and 7, a coil C2 has traveled along the second input line 200*b* to the mandrel 220 of the workstation 218. The workstation 218 is positioned at the second end 204*b* of the second input line 200*b*, and the mandrel 220 is aligned with the second input line 200*b*, and thus with the open core O of the coil C2. The trolley 206*b* continues to travel to the second end 204*b* of the input line 200*b*, so that the open core O of the coil C2 passes over or around the mandrel 220 of the workstation 218. The coil support bed 216 of the trolley 206*b* is then lowered, generally as shown in FIG. 7.

Figure 8:
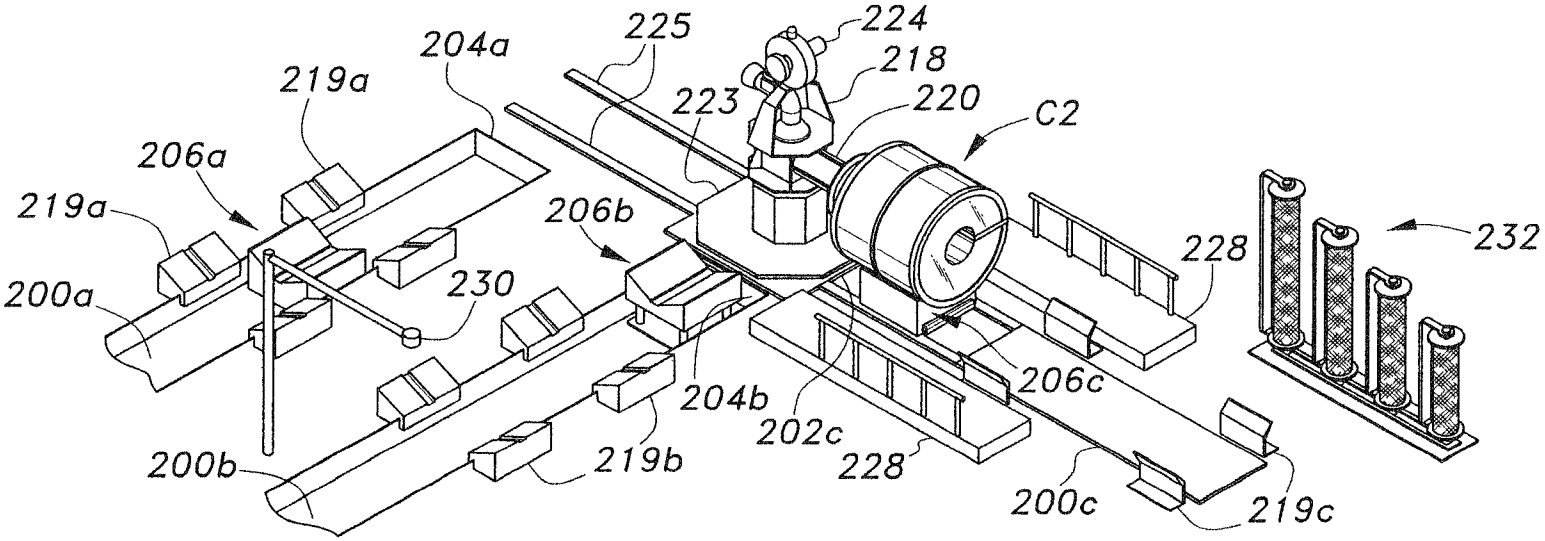
FIG. 8 is a partial perspective view of a portion of the apparatus of FIG. 5, illustrating a subsequent step in the packaging method.
Figure 9:
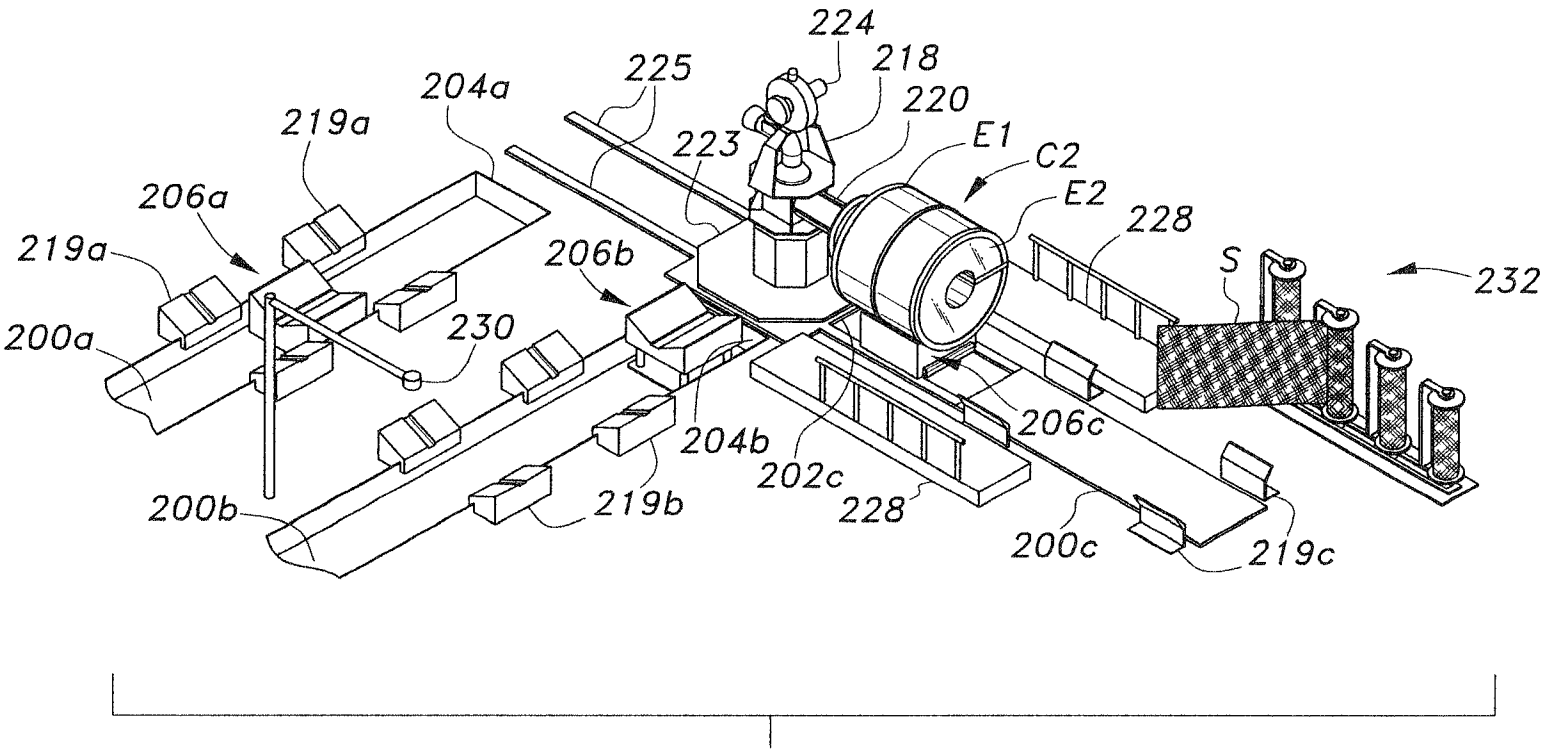
FIG. 9 is a partial perspective view of a portion of the apparatus of FIG. 5, illustrating a subsequent step in the packaging method.
Figure 10:
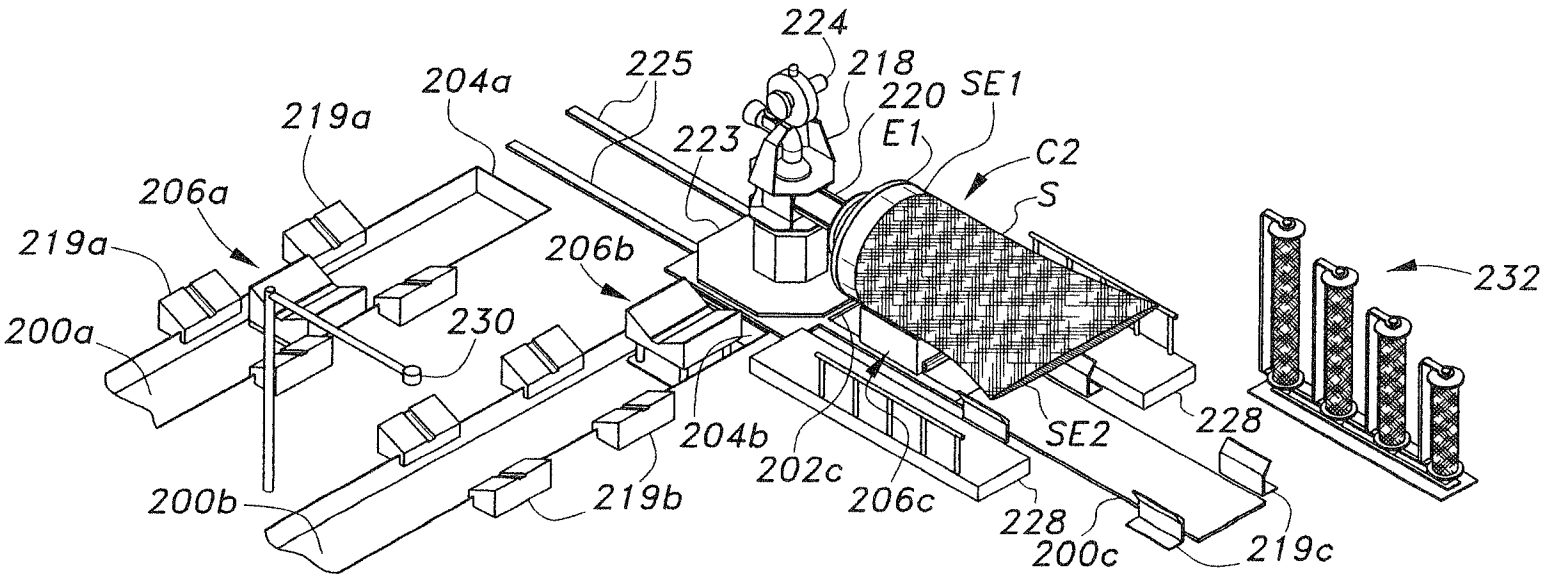
FIG. 10 is a partial perspective view of a portion of the apparatus of FIG. 5, illustrating a subsequent step in the packaging method.

In FIG. 8, the mandrel 220 and the coil C2 thereon has been rotated or pivoted 90° to align with the output line 200*c*. At this point, a length of coil wrapping or packaging sleeve S may be dispensed from a roll of such material at the packaging sleeve dispensing station 232, generally as shown in FIG. 9 of the drawings. The sleeve dispensing station 232 may have several rolls of sleeve material, each roll providing packaging sleeves of different diameters or circumferences to fit different sizes, diameters, or circumferences of coiled material, as appropriate. A length of coil packaging sleeve material S is cut from the appropriate roll to provide sufficient length to extend over the outer surface and second end E2 of the coil C2, through the open core O, and over the opposite first end E1 of the coil C2. The first sleeve end SE1 is then pulled axially over the outer circumference of the coil C2 to the first end E1 of the coil C2, generally as shown in FIG. 10 of the drawings, and secured thereto by any convenient means, e.g., adhesive tape, etc.

Figure 11:
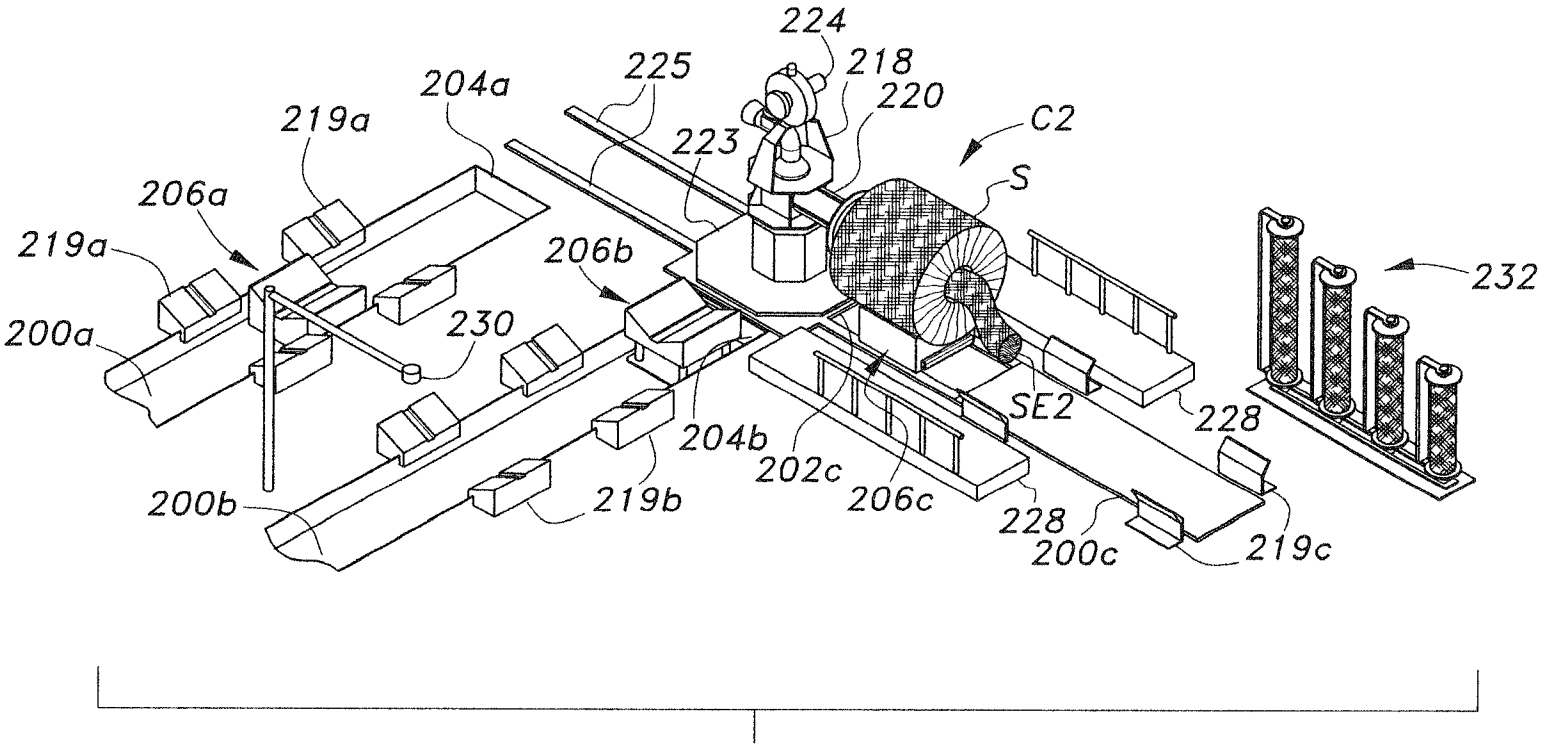
FIG. 11 is a partial perspective view of a portion of the apparatus of FIG. 5, illustrating a subsequent step in the packaging method.
Figure 12:
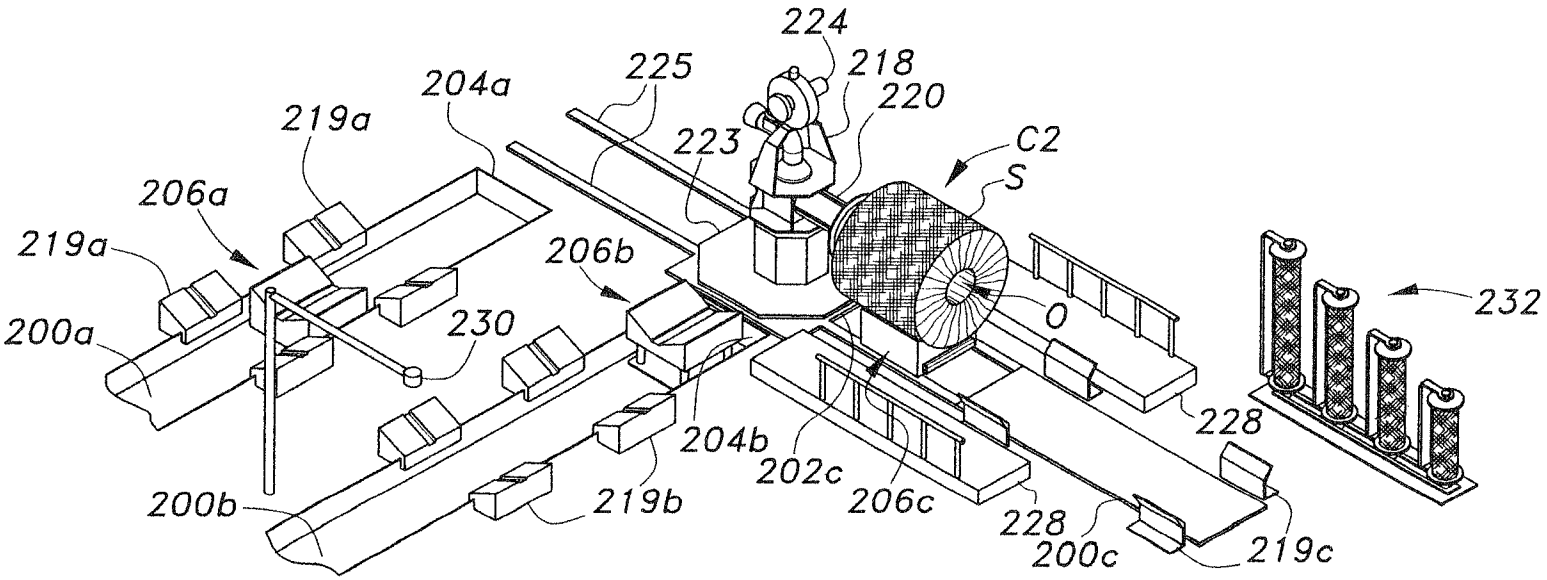
FIG. 12 is a partial perspective view of a portion of the apparatus of FIG. 5, illustrating a subsequent step in the packaging method.

The free portion of the sleeve S is then drawn around the second end E2 of the coil C2, generally as shown in FIG. 11, and the second end of the sleeve SE2 is then inserted into the open core O of the coil C2, generally as shown in FIG. 12 of the drawings. The second end of the sleeve SE2 need not be tucked very far into the open core O of the coil C2, but only needs to be inserted sufficiently to place all of the free material of the sleeve S within the open core O.

Figure 13:
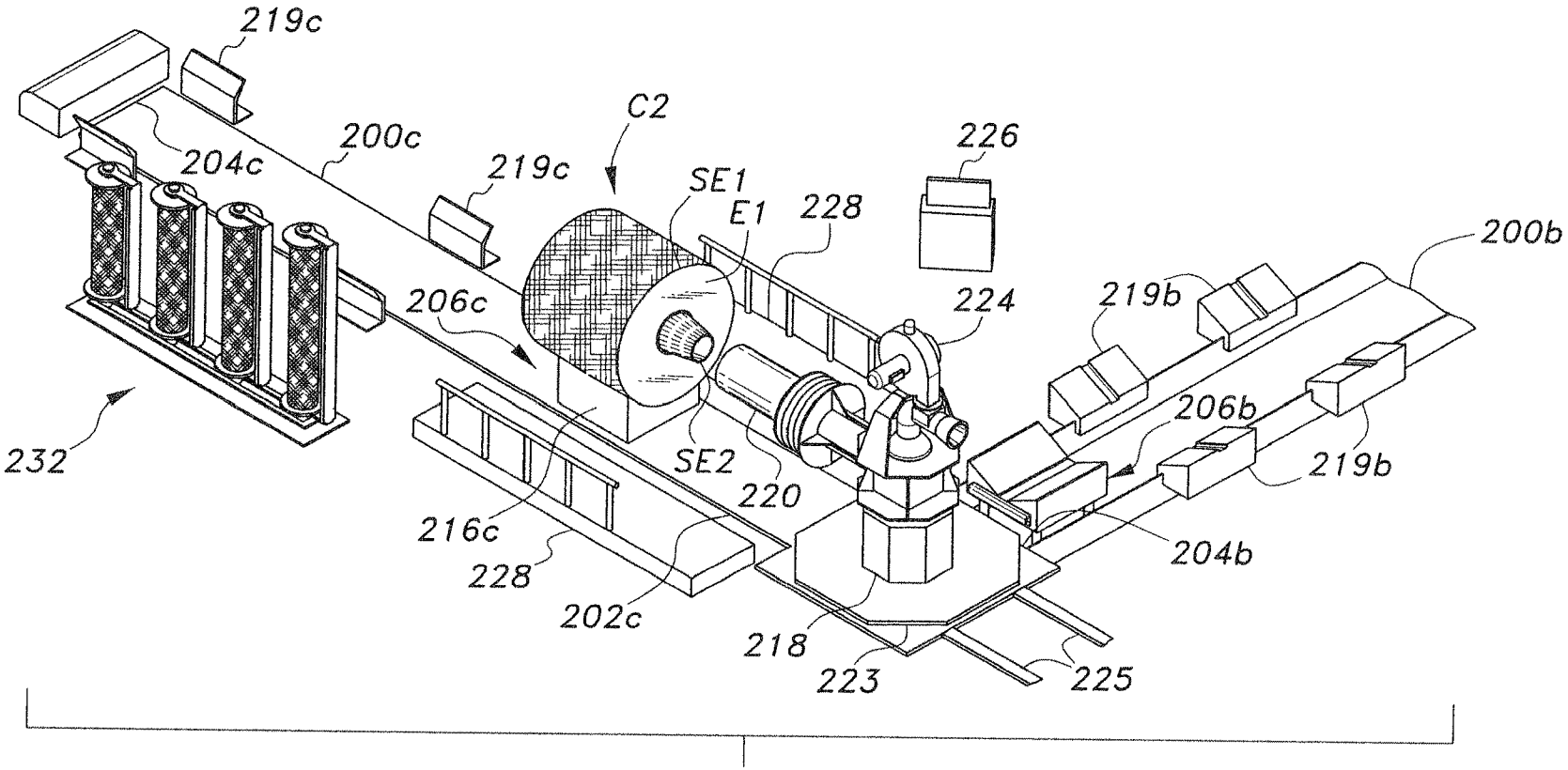
FIG. 13 is a partial perspective view of a portion of the apparatus of FIG. 5, illustrating a subsequent step in the packaging method.

When the above has been accomplished, the suction pump or vacuum pump 224 of the workstation 218 is activated to draw the free second end SE2 of the sleeve S through the open core O of the coil C2. The coil support bed 216*c* of the third coil delivery trolley 206*c* on the output line 200*c* is then raised to lift the coil C2 from the mandrel 220, and the trolley 206*c* with the partially packaged coil C2 thereon is moved away from the workstation 218 toward the second end 204*c* of the output line 200*c* to expose the free second end SE2 of the sleeve S and the first end E1 of the coil, generally as shown in FIGS. 13 and 15 of the drawings. The workstation 218 can then be repositioned at the second end 204*a* of the first input line 200*a* to await a coil traveling along that line, generally as shown in FIG. 14 of the drawings.

When the above steps have been accomplished, the free second end of the sleeve SE2 is pulled radially outward from the open core O of the coil C2 to cover the otherwise exposed first end E1 of the coil C2. This step is shown partially completed in FIG. 16 of the drawings. The sleeve material S is pulled outward to completely cover the first end E1 of the coil C2, and is pulled further over the outer circumference of the coil C2 to overlap the previously secured first end SE1 of the sleeve S. The second end SE2 of the sleeve S is then secured to and over the underlying first end SE1 of the sleeve S by the application or installation of a circumferential sleeve or packaging retaining band 234, generally as shown in FIG. 17. It will be noted that the end E1 of the coil C2 with the first end SE1 and overlapping second end SE2 of the sleeve S extend beyond the coil support bed 216*c* of the output line trolley 206*c*, thus enabling personnel to reach completely around the circumference of the coil C2 to apply the sleeve retaining band 234 about the overlapping ends SE1, SE2 of the sleeve S.

Figure 18:
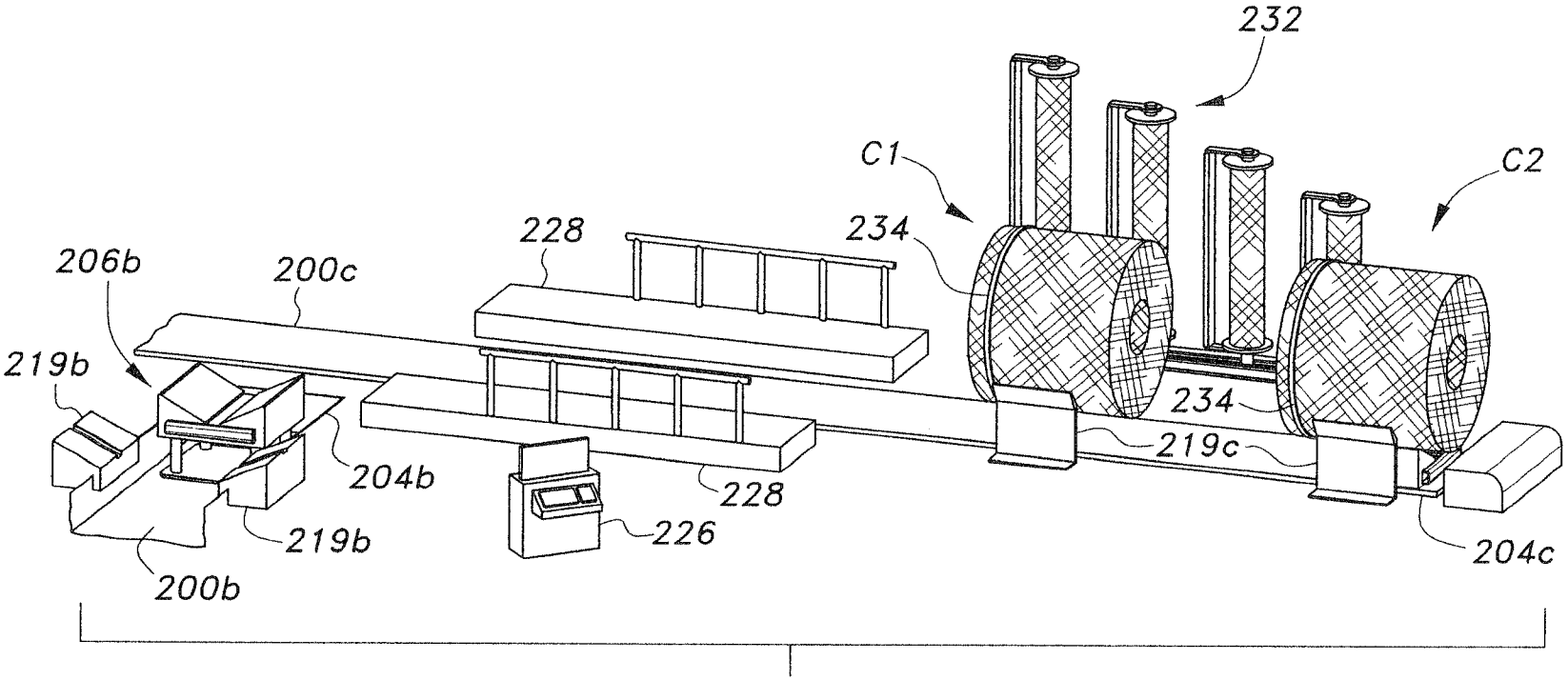
FIG. 18 is a partial perspective view of a portion of the apparatus of FIG. 5, illustrating a subsequent step in the packaging method.

The above-described process alternates between the first and second input lines 200*a* and 200*b* so that alternating packaged coils C1 and C2 proceed down the output line 200*c*, generally as shown in FIG. 18 of the drawings. In FIG. 18, the second coil C2 has advanced farther down the output line 200*c* than the first coil C1, as in the previous FIGS. 6 through 17, a coil C2 advanced along the second input line 200*b*. Substantially the same processing procedure is used to advance and package a coil C1 traveling along the first input line 200*a* and being transferred to the output line 200*c*, in this case following the second coil C2 during the packaging operation.

Figure 19:
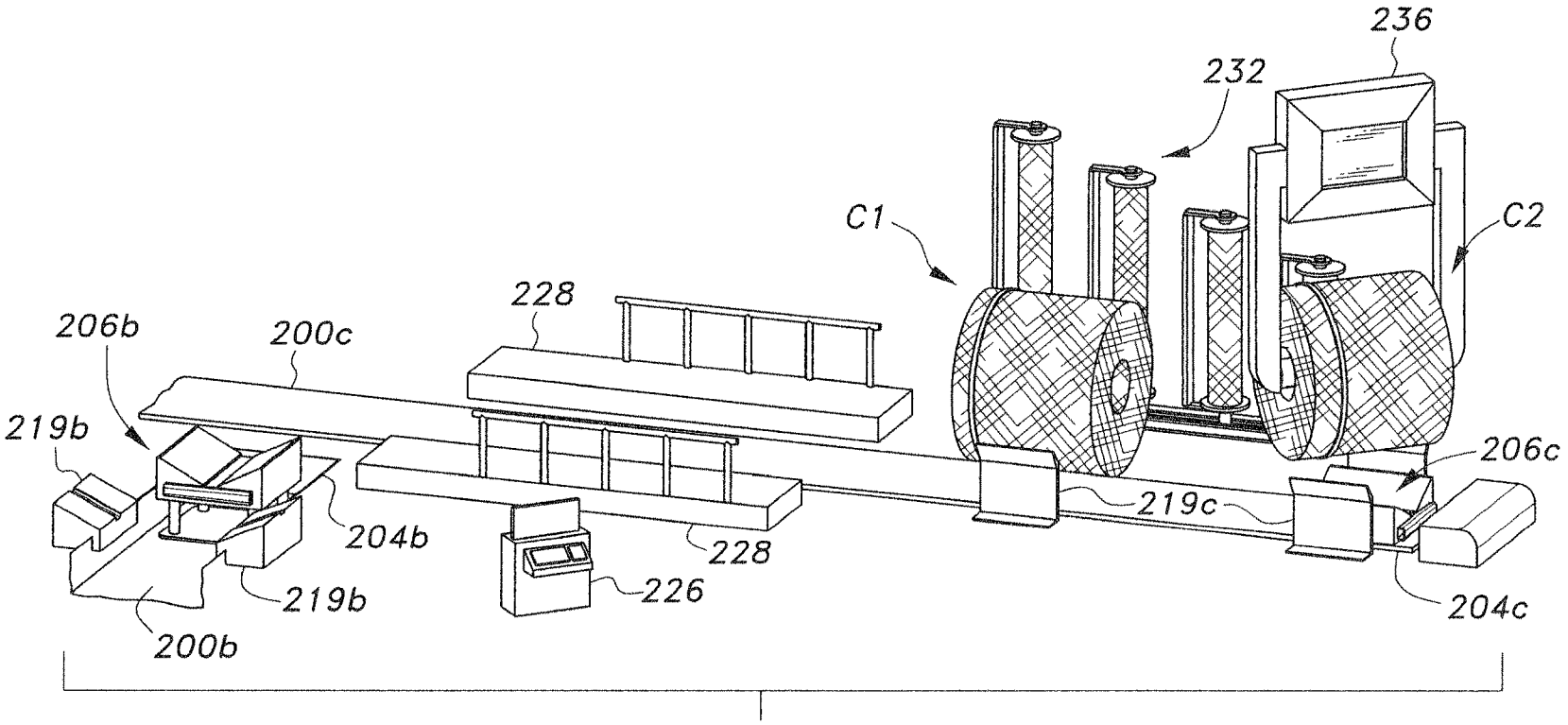
FIG. 19 is a partial perspective view of a portion of the apparatus of FIG. 5, illustrating the final step in the packaging method.

Finally, FIG. 19 shows the removal of the completely packaged coils C1, C2 from the output line 200*c*. A crane 236 or other suitable machine or device is used to lift the completely packaged coils C2 and C1 from the second end 204*c* of the output line 200*c*. In FIG. 19, the first coil C2 to travel down the output line 200*c* is being lifted from its trolley 206*c* for placement upon a suitable conveyance for transport to a storage area or to a delivery vehicle (truck, etc.). Once the coil C2 has been removed and the machine 236 is free, it is used to pick up the first coil C1. The process continues, with alternating coils C1 and C2 proceeding down the two input lines 200*a*, 200*b* for banding and placement upon the mandrel 220 of the workstation 218 as the workstation 218 reciprocates between the second ends 204*a*, 204*b* of the two input lines 200*a*, 200*b*. The coils C1, C2 are transferred in alternating order to the single output line 200*c* for packaging and delivery from the line 200*c*, generally as described above.

Figure 20:
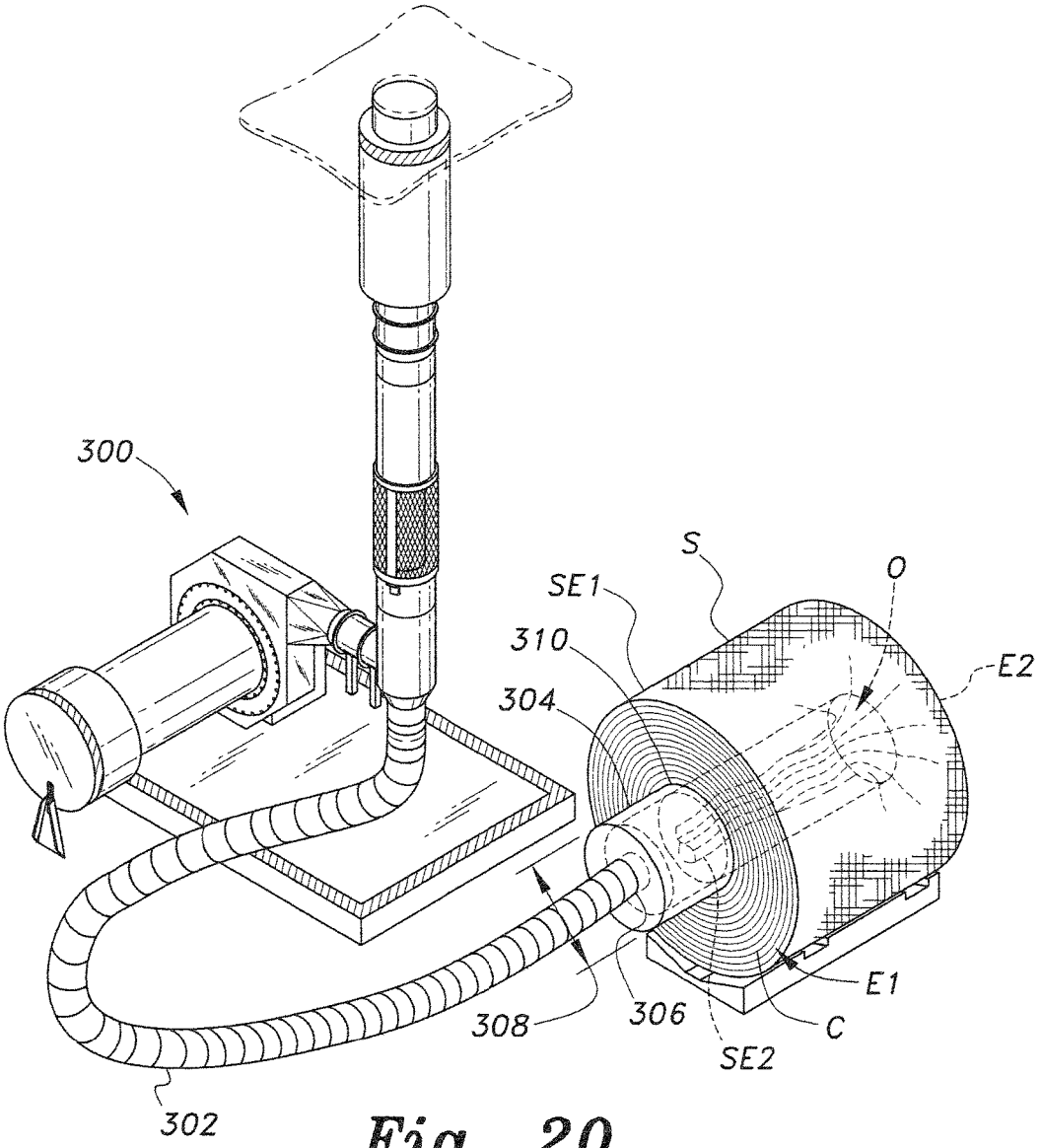
FIG. 20 is a perspective view of a third embodiment of an apparatus for packaging coiled materials according to the present invention, illustrating its general configuration and operation.

FIG. 20 provides an illustration of a third embodiment of the apparatus for packaging coiled materials. The embodiment of FIG. 20 is adapted for periodic packaging of separately handled individual coils, rather than the packaging of coils in sequence along a production line. The apparatus of FIG. 20 includes a suction or vacuum source 300 having a flexible suction line or hose 302 extending therefrom. A vacuum or suction canister 304 is attached to the distal end 306 of the hose 302. The canister 304 has a diameter 308 at least as large, if not slightly larger, than that of the open core O of the coil C. The canister 304 serves essentially the same function as the mandrels 120 and 220, respectively of the first embodiment of FIGS. 1 through 4 and the second embodiment of FIGS. 5 through 19.

Operation of the coil packaging apparatus of FIG. 20 is generally along the same lines as the operation of the first and second embodiments of FIGS. 1 through 19. The coil C is initially supported free of the underlying surface by any conventional means, e.g., a forklift tine(s) inserted through the open core O of the coil C, etc. The packaging sleeve S is then passed over and around the outer surface of the coil C. The first sleeve end SE1 is secured to the first end E1 of the coil C. The opposite second end SE2 of the packaging sleeve S is then loosely inserted into the open core O of the coil C, at the second end E2 of the coil.

At this point the suction or vacuum apparatus 300 is engaged to provide suction to the canister 304 at the distal end of the hose 302, and the open end 310 of the canister 304 is applied to the open core O of the coil C at the first end E1 thereof. (The canister 304 may be provided with a control switch, with wiring extending along the hose 302 or a wireless link communicating with the suction source 300 to actuate the suction source selectively.) The suction developed by the suction source 300 and applied through the hose 302 to the canister 304 draws the free second sleeve end SE2 through the open core O of the coil C in substantially the same manner as the fixed mandrels 120 and 220 of the first and second embodiments. The suction or vacuum source is then shut down, and the canister 304 is removed from the open core O at the first end SE1 of the coil C. The wrapping or packaging process is completed as described further above for the first and second embodiments, i.e., sealing the two ends SE1 and SE2 of the sleeve S to one another and installing protective edge protectors and a retaining band on the wrapped or packaged coil, substantially as shown in FIGS. 4, 6, 7 and described further above.

It is to be understood that the present invention is not limited to the embodiments described above, but encompasses any and all embodiments within the scope of the following claims.

I claim:

1. A method for packaging coiled materials using an apparatus for packaging coiled materials comprising: at least one input line having a first end and a second end opposite the first end; an output line extending orthogonally from the second end of the input line; a workstation disposed at the second end of the input line; a mandrel extending horizontally from the workstation, the mandrel having a hollow core; a suction device mounted on the workstation, the suction device communicating with the hollow core of the mandrel; and further comprising a vertically adjustable coil delivery trolley disposed upon the input line, the method comprising the steps of:

(a) disposing a vertically adjustable coil delivery trolley upon the input line;
(b) placing a coil of material upon the coil delivery trolley, the coil of material having mutually opposed first and second ends and an open core;
(c) vertically adjusting the coil delivery trolley to align the open core of the coil of material with the mandrel;
(d) moving the coil delivery trolley beneath the mandrel to pass the open core of the coil of material around the mandrel;
(e) lowering the coil delivery trolley from beneath the coil;
(f) providing a packaging sleeve, the sleeve having a closed circumference and open opposed first and second ends;
(g) passing the packaging sleeve over the coil;
(h) securing a first end of the sleeve to the first end of the coil;
(i) tucking a second end of the sleeve into the open core of the coil at the second end of the coil;
(j) applying suction through the mandrel, thereby drawing the second end of the sleeve through the open core of the coil;
(k) moving the coil delivery trolley and the coil disposed thereon clear of the mandrel;
(l) drawing the second end of the sleeve radially outward to cover the first end of the coil; and
(m) securing the second end of the sleeve over the first end of the sleeve, thereby completely enclosing the coil within the sleeve.

2. The method for packaging coiled materials according to claim 1, wherein the at least one input line comprises a first input line and a second input line parallel to the first input line, the workstation selectively translating between the first input line and the second input line.

3. The method for packaging coiled materials according to claim 1, further comprising the step of applying first and second edge protectors respectively to the first and second ends of the coil, prior to initiating step (g).

4. The method for packaging coiled materials according to claim 1, further comprising the step of applying a retaining band circumferentially about the coil, the first end of the sleeve, and the second end of the sleeve, after completing step (m).

5. The method for packaging coiled materials according to claim 1, wherein the at least one input line includes a single input line.

6. The method for packaging coiled materials according to claim 1, wherein the mandrel is selectively pivotal between alignment with the input line and alignment with the output line.

* * * * *